US007391415B2

(12) United States Patent
Lee et al.

(10) Patent No.: US 7,391,415 B2
(45) Date of Patent: Jun. 24, 2008

(54) PLASMA DISPLAY PANEL, DRIVING APPARATUS AND METHOD THEREOF

(75) Inventors: Jun-Young Lee, Suwon-si (KR); Byung-Nam An, Suwon-si (KR); Jong-Soo Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 637 days.

(21) Appl. No.: 10/992,199

(22) Filed: Nov. 19, 2004

(65) Prior Publication Data

US 2005/0110710 A1 May 26, 2005

(30) Foreign Application Priority Data

Nov. 24, 2003 (KR) ..... 10-2003-0083601

(51) Int. Cl.
*G09G 5/00* (2006.01)

(52) U.S. Cl. ..... 345/211; 345/60; 345/208

(58) Field of Classification Search ..... 345/211–213, 345/60, 208
See application file for complete search history.

(56) References Cited

U.S. PATENT DOCUMENTS 5,438,290 A * 8/1995 Tanaka ..... 327/108
6,628,087 B2 * 9/2003 Roh et al. ..... 315/169.3
6,727,659 B2 * 4/2004 Kim et al. ..... 315/169.1
7,006,057 B2 * 2/2006 Jin et al. ..... 345/60
2003/0057854 A1 * 3/2003 Roh ..... 315/169.3
2004/0196217 A1 * 10/2004 Okamura et al. ..... 345/60

FOREIGN PATENT DOCUMENTS

JP 05265396 10/1993
JP 2002351388 12/2002
KR 1020020078144 10/2002

* cited by examiner

*Primary Examiner*—Kent Chang
(74) *Attorney, Agent, or Firm*—H.C. Park & Associates, PLC

(57) ABSTRACT

A plasma display panel driving apparatus that applies a voltage to a first electrode of a panel capacitor, comprising an inductor, a first switch, a second switch, a reset driver which applies a reset voltage to the first electrode in a reset period, a third switch, and a fourth switch. The plasma display panel driving apparatus forms a switching unit that applies a sustain voltage to Y electrodes in front of a scan IC and reduces a sustain discharging path.

14 Claims, 5 Drawing Sheets

PLASMA DISPLAY PANEL, DRIVING APPARATUS AND METHOD THEREOF

CROSS REFERENCE TO RELATED APPLICATION

This application claims priority to and the benefit of Korean Patent Application No. 10-2003-0083601, filed on Nov. 24, 2003, which is hereby incorporated by reference for all purposes as if fully set forth herein.

BACKGROUND OF THE INVENTION

1. Field of the Invention

The present invention relates to an apparatus and method for driving a plasma display panel (PDP).

2. Discussion of the Related Art

Various types of flat panel displays, including liquid crystal displays (LCDs), field emission displays (FEDs), and PDPs, are being developed. Generally, the PDP has higher resolution, higher emission efficiency, and a wider viewing angle than other flat panel displays. Accordingly, it is regarded as a principle substitute for the conventional cathode ray tube (CRT), especially for large-sized displays greater than forty inches.

The PDP displays characters or images using plasma generated by gas discharge, and it may include hundreds of thousands to millions of pixels arranged in a matrix format, depending upon its size. Plasma display panels are typically divided into direct current (DC) and alternating current (AC) type PDPs according to an applied driving voltage waveform and discharge cell structure.

Since electrodes of the DC PDP are exposed in a discharge space where current flows due to an applied voltage, a resistor is required for current limitation. To the contrary, a dielectric layer covers the electrodes of the AC PDP and limits currents because of naturally forming capacitance components. Further, the dielectric layer protects the electrodes from ion impulses during discharging, which provides the AC PDP with a longer life span than the DC PDP.

Pairs of scan electrodes and sustain electrodes are formed on a first substrate of the AC PDP, and address electrodes are formed crossing them on a second substrate. The sustain electrodes may be formed corresponding to each scan electrode.

A conventional method for driving the AC PDP includes a reset period, an address period, and a sustain period, which are represented by changes of the operation according to time.

In the reset period, a status of each cell is initialized so as to stably perform subsequent address discharging. In the address period, an address voltage is applied to cells that are to be turned on (addressed cells), and wall charges accumulate to the addressed cells. In the sustain period, a discharge for displaying images on the addressed cells is performed.

In a conventional PDP, the sustain and scan electrode driving circuits generate sustain discharge voltage pulses. However, more circuit units may be included in the scan electrode driving circuit because it may also generate reset and scan pulses, in addition to the sustain discharge pulses.

FIG. 1 is a diagram showing a conventional scan electrode driving circuit.

As shown FIG. 1, a conventional scan electrode driving circuit may include a sustain driver 221, including a power recovery circuit, a reset driver 222, including a main path switch, and a scan driver 223, including a scan integrated circuit (IC).

As shown by the arrow in FIG. 1, applying a discharge voltage to the scan electrode (represented by a terminal of the panel capacitor Cp) from the sustain driver 221 forms a current path that passes through the reset driver 222, including the main path switch, and the scan driver 223.

Parasitic inductance (circled in FIG. 1) formed by a pattern on the main discharge path may distort voltage waveforms, which may degrade discharge states. This degradation may worsen as the panel size increases.

SUMMARY OF THE INVENTION

The present invention provides a method and apparatus for driving a PDP having a shortened main discharge path of scan electrodes, which may eliminate waveform distortion.

Additional features of the invention will be set forth in the description which follows, and in part will be apparent from the description, or may be learned by practice of the invention.

The present invention discloses a PDP driving apparatus for applying a voltage to a first electrode of a panel capacitor. The apparatus comprises an inductor, a first switch, a second switch, a reset driver, a third switch, and a fourth switch. A first terminal of the inductor is coupled to the first electrode, the first switch is coupled between a second terminal of the inductor and a first power for supplying a first voltage, and the second switch is coupled between the second terminal of the inductor and the first power. The reset driver is coupled between the first terminal of the inductor and the first electrode and applies a reset voltage to the first electrode in a reset period. The third switch is coupled between a node of the reset driver and the first electrode, and a second power, which supplies a second voltage for a sustain discharging, and the fourth switch is coupled between the node of the reset driver and the first electrode, and a third power, which supplies a third voltage.

The present invention also discloses a method for driving the above PDP apparatus including turning on the first switch to charge the panel capacitor by resonance of the inductor and the panel capacitor, turning off the first switch and turning on the third switch to maintain a voltage at the first electrode at the second voltage, turning on the second switch to discharge the panel capacitor by resonance of the inductor and the panel capacitor, and turning off the second switch and turning on the fourth switch to maintain the voltage at the first electrode at the third voltage.

The present invention also discloses a PDP device comprising a panel unit including a plurality of first electrodes and a plurality of second electrodes formed on a substrate, and a chassis base having a driving board for driving the panel unit. The driving board, which has a circuit for applying a voltage for sustain discharging to the first electrodes, comprises an inductor of which a first terminal is coupled to the first electrode; a first switch coupled between a second terminal of the inductor and a first power supplying a first voltage; a second switch coupled between the second terminal of the inductor and the first power; a reset driver coupled between the first terminal of the inductor and the first electrode, for applying a reset voltage to the first electrode in a reset period; a third switch coupled between a node of the reset driver and the first electrode, and a second power supplying a second voltage for sustain discharging; and a fourth switch coupled between the node of the reset driver and the first electrode, and a third power supplying a third voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
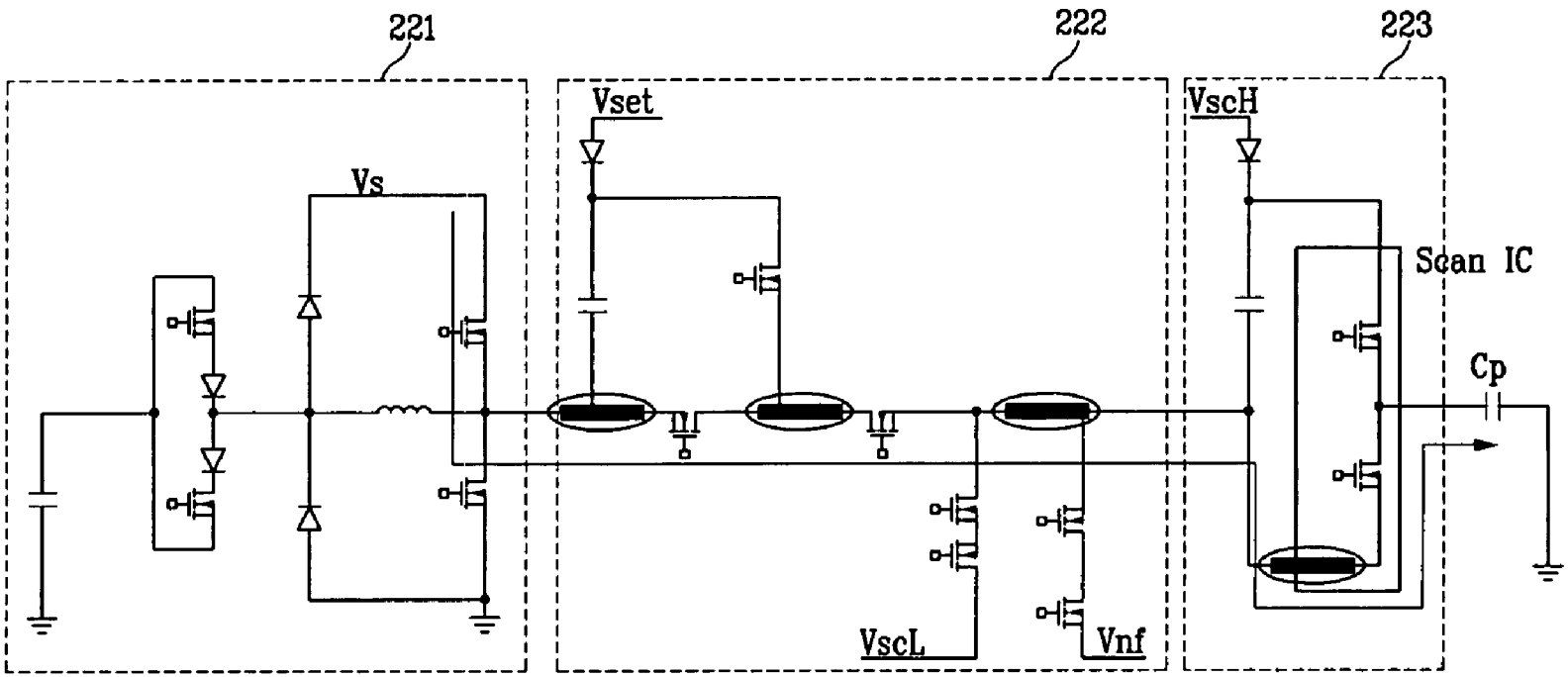
FIG.1 (Prior Art)
FIG. 1 is a diagram showing a conventional scan electrode driving circuit.

The following detailed description shows and describes exemplary embodiments of the present invention, simply by way of illustration of the best mode contemplated by the inventors of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

An apparatus and method for driving a PDP according to an exemplary embodiment of the present invention will be described with reference to the drawings.

Figure 2:
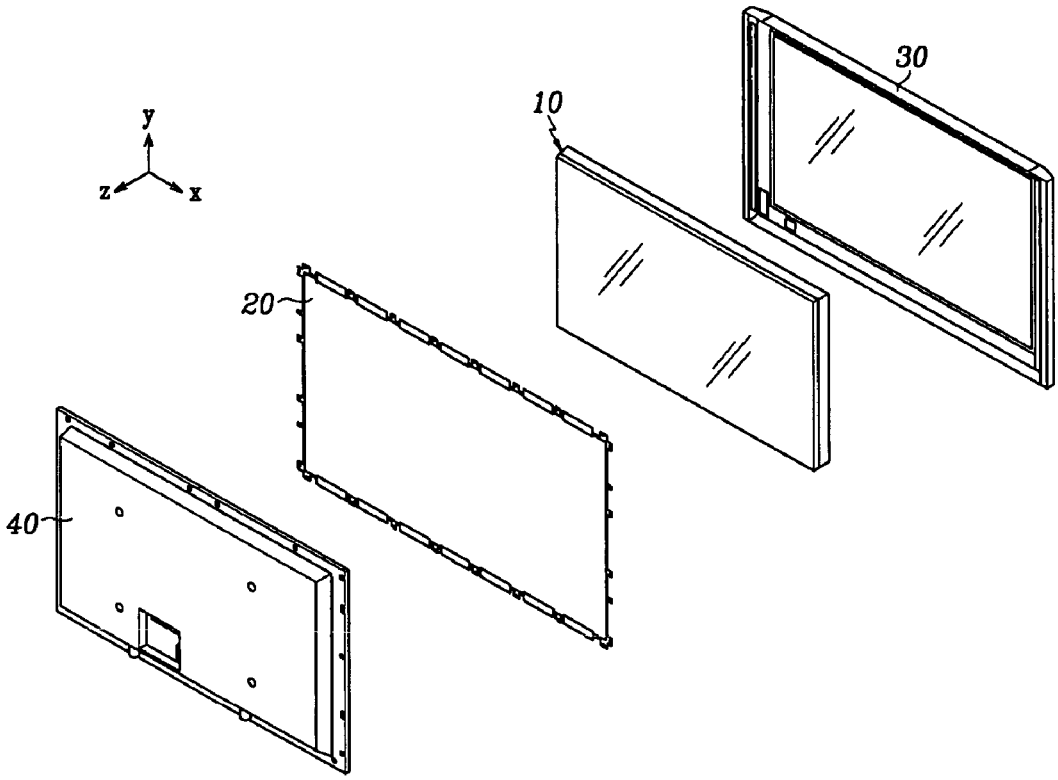
FIG. 2 is a perspective view showing a plasma display device according to an exemplary embodiment of the present invention.
Figure 3:
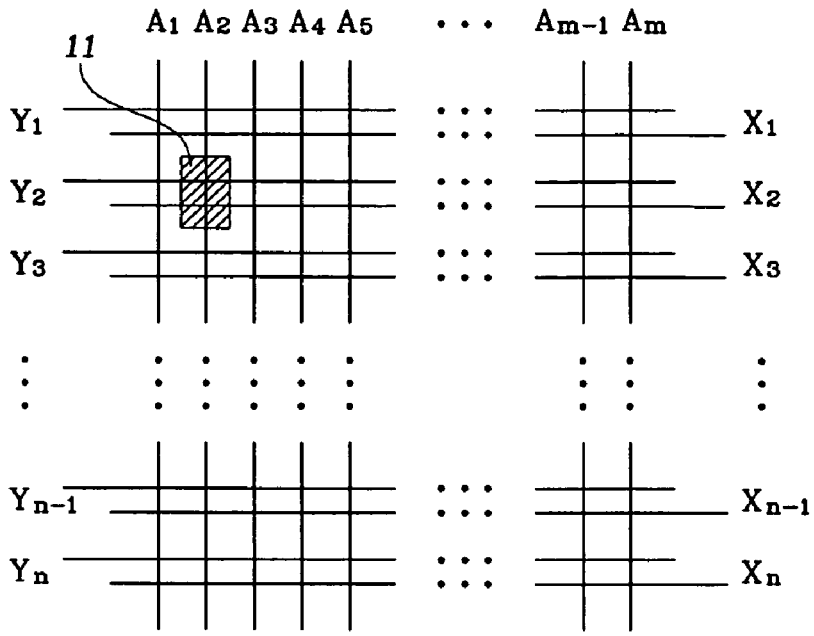
FIG. 3 shows an arrangement of PDP electrodes according to an exemplary embodiment of the present invention.
Figure 4:
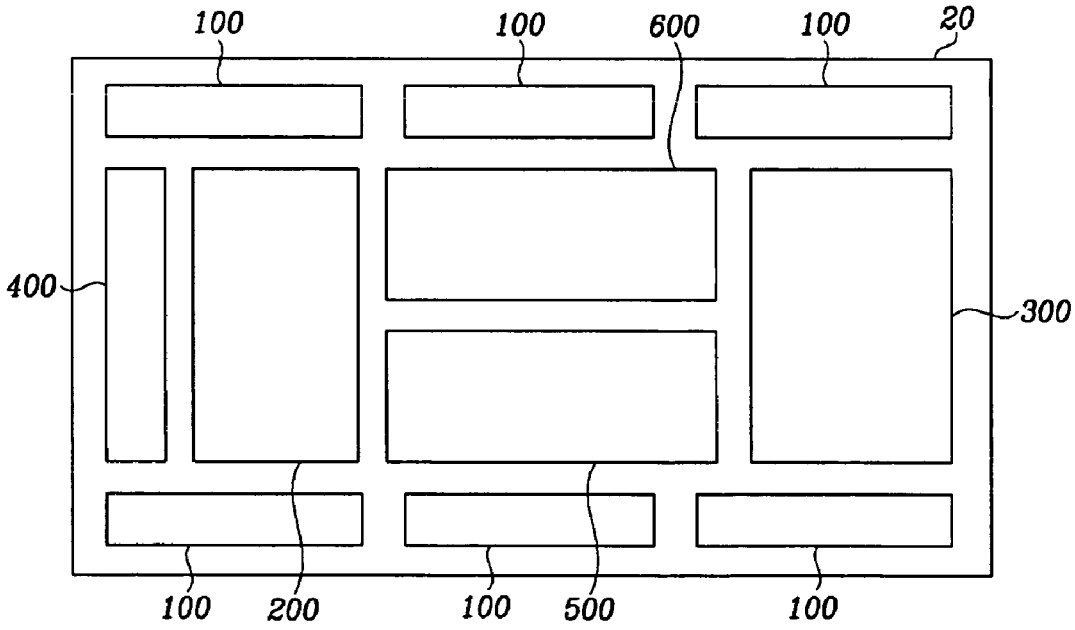
FIG. 4 shows a chassis base according to an exemplary embodiment of the present invention.

A schematic formation of a PDP device according to an exemplary embodiment of the present invention will be described with reference to FIG. 2, FIG. 3 and FIG. 4. FIG. 2 is a perspective view showing a PDP device according to an exemplary embodiment of the present invention. FIG. 3 is a schematic plane diagram showing the PDP according to an exemplary embodiment of the present invention. FIG. 4 is a schematic plane diagram showing a chassis base according to an exemplary embodiment of the present invention.

As shown in FIG. 2, the PDP device includes a plasma panel 10, a chassis base 20, a front case 30, and a rear case 40. The chassis base 20 is coupled to a rear side of the plasma panel 10. The front and rear cases 30 and 40 are arranged on a front side of the plasma panel 10 and a rear side of the chassis base 20, respectively, and coupled to the plasma panel 10 and the chassis base 20 to form the PDP device.

As shown in FIG. 3, the plasma panel 10 includes a plurality of address electrodes $A_1$ to $A_m$, which are arranged in a column direction on a first glass substrate, and a plurality of scan electrodes $Y_1$ to $Y_n$ and a plurality of sustain electrodes $X_1$ to $X_n$, which are alternately arranged in a row direction on a second glass substrate. The sustain electrodes $X_1$ to $X_n$ are formed corresponding to the respective scan electrodes, terminals of the scan electrodes may be coupled to each other, and terminals of the sustain electrodes may be coupled to each other. The first and second glass substrates are sealed together, with a discharge space therebetween, so that the scan electrodes $Y_1$ to $Y_n$ and the sustain electrodes $X_1$ to $X_n$ cross the address electrodes $A_1$ to $A_m$. Portions of the discharge space between the address electrodes $A_1$ to $A_m$ and a crossing part of the sustain electrodes $X_1$ to $X_n$ and the scan electrodes $Y_1$ to $Y_n$ form discharge cells 11.

As shown in FIG. 4, boards 100, 200, 300, 400, 500 and 600 for driving the plasma panel may be coupled to the chassis base 20. Address buffer boards 100 may be formed on upper and lower sides of the chassis base 20 for a dual-driven PDP device, as shown in FIG. 4, or they may be formed on one side for a single driving device. Additionally, the address buffer boards 100 may be formed as a single board or a plurality of boards. The address buffer board 100 receives an address driving control signal from an image processing and logic board 500, and applies a voltage for selecting a discharge cell to be displayed to the address electrodes $A_1$ to $A_m$.

A scan driving board 200 and a sustain driving board 300 may be arranged on left and right sides of the chassis base 20, and the scan driving board 200 may be coupled to the scan electrodes $Y_1$ to $Y_n$ through a scan buffer board 400, which allows scanning of the scan electrodes. The scan driving board 200 and the sustain driving board 300 receive a sustain discharge signal from the image processing and logic board 500, and they alternately input sustain discharging pulses to the scan electrodes $Y_1$ to $Y_n$ and the sustain electrodes $X_1$ to $X_n$, thereby generating sustain discharges at the selected discharge cells. The scan driving board 200 and the sustain driving board 300 are shown as separate boards in FIG. 4, but the boards 200 and 300 may be formed as a single board. Additionally, the scan buffer board 400 and the scan driving board 200 may also be formed as a single board.

The image processing and logic board 500 receives image signals, generates address driving control signals and Y and X sustain discharging signals, and applies those signals to the address driving board 100, the scan driving board 200, and the sustain driving board 300, respectively. A power supply board 600 supplies power for driving the PDP device. The image processing and logic board 500 and the power supply board 600 may be arranged at the center of the chassis base.

A structure and operation of a Y electrode driver included in the scan driving board 200 according to an exemplary embodiment of the present invention will be described with reference to FIG. 5.

Figure 5:
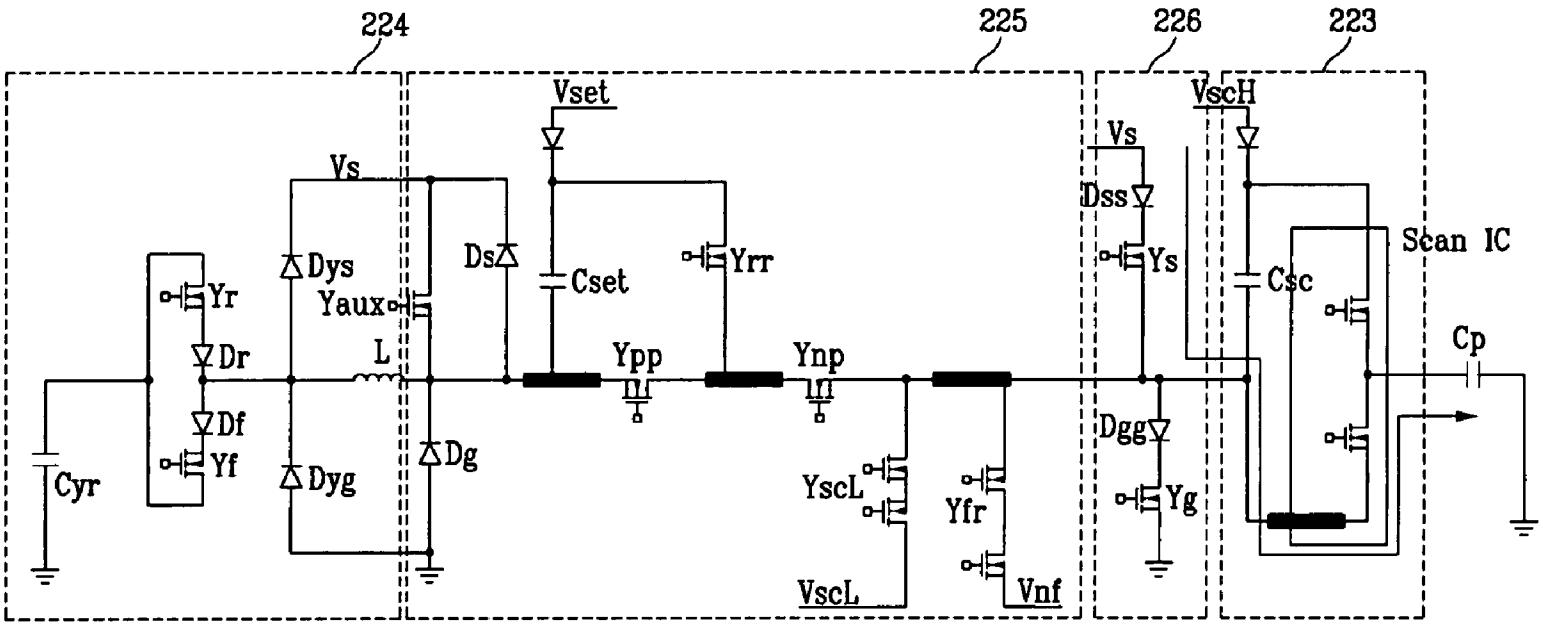
FIG. 5 is a diagram showing a scan electrode driving circuit according to an exemplary embodiment of the present invention.

FIG. 5 is a diagram showing a Y electrode driver circuit according to an exemplary embodiment of the present invention.

As shown in FIG. 5, the Y electrode driver may include a scan driver 223, a power recovery unit 224, a reset driver 225, and a sustain driver 226.

The scan driver 223, which applies scan signals to the Y electrodes in an address period, includes a power $V_{scH}$, a capacitor $C_{sc}$, and a scan IC.

The power recovery unit 224, which charges and discharges a panel capacitor $C_P$ by LC resonance in a sustain period, includes a capacitor $C_{yr}$, charged with a voltage of $V_s/2$, a switch $Y_r$ and a diode $D_r$ for forming a charging path, a switch $Y_f$ and a diode $D_f$ for forming a discharging path, an inductor L, and clamping diodes $D_{ys}$ and $D_{yg}$.

Prior to the sustain period, the capacitor Cyr may be charged with the voltage of Vs/2. In the sustain period, when the switch Yr is turned, the panel capacitor $C_P$ may be charged by resonance generated between it and the inductor L, and it may be discharged by resonance generated between it and the inductor L when the switch Yf is turned on.

The diodes $D_r$ and $D_f$ may be formed in the opposite direction of body diodes of the switches $Y_r$ and $Y_f$ in order to interrupt currents that are generated by the body diodes of the switches $Y_r$ and $Y_f$. The clamping diodes $D_{ys}$ and $D_{yg}$ clamp the power of $V_s$ and a second terminal potential of the inductor L.

The reset driver 225, which applies a rising waveform and a falling waveform to the Y electrodes in a reset period, may include a capacitor $C_{set}$ for charging a voltage of $V_{set}$, a rising ramp switch $Y_{rr}$, and a falling ramp switch $Y_{fr}$, which may be formed with two switches of opposite directions that are coupled in series in order to interrupt a current caused by the body diode. The reset driver 225 may further include a switch $Y_{aux}$ for supplying a voltage of $V_s$ in the reset period, clamping diodes $D_s$ and $D_g$, and switches $Y_{pp}$ and $Y_{np}$, which are formed on a main path. A small-capacity switch may be used for the switch $Y_{aux}$.

Prior to the reset period, the capacitor $C_{set}$ may be charged with a voltage of $V_{set}$-$V_s$ when the switch $Y_g$ is turned on. In an early stage of the reset period, the switch $Y_{aux}$ may be turned on to apply the voltage of $V_s$ to the Y electrodes, and a voltage at the panel capacitor $C_P$ gradually increases to the voltage of $V_{set}$ by the voltage charged in the capacitor $C_{set}$ when the switch $Y_{rr}$ is turned on.

The reset driver 225 may also include a switch $Y_{scL}$ for applying a scan voltage of $V_{scL}$ to the Y electrodes in the address period. The switch $Y_{scL}$ may be formed with transistors coupled in a back to back method in order to resist a withstand voltage.

When a waveform rising to the voltage of $V_{set}$ is applied to the panel capacitor $C_P$, the switch $Y_{aux}$ is turned on and the switch $Y_{rr}$ is turned off to apply the voltage of $V_s$ to the Y electrodes, and when the switch $Y_{fr}$ is turned on, a voltage that is charged in the Y electrode gradually decreases to the voltage of $V_{nf}$.

The scan voltage of $V_{scL}$ and a final voltage of $V_{nf}$ in the falling ramp waveform may be equal. During a later part of the reset period, the reset driver 225 is driven with the falling ramp switch $Y_{fr}$ without using the switch $Y_{scL}$ and the voltage $V_{scL}$.

The sustain driver 226 includes switches $Y_s$ and $Y_g$, which may be coupled in series between the power of $V_s$ and a ground terminal, and diodes $D_{ss}$ and $D_{gg}$, which may be for determining a current path. The switch $Y_s$ may couple the panel capacitor $C_P$ to the voltage $V_s$, and the switch $Y_g$ may couple the panel capacitor $C_p$ to ground.

In the Y electrode driver according to an exemplary embodiment of the present invention, the power recovery unit 224 and the sustain driver 226 are separated in order to reduce a sustain discharging path through which the sustain voltage is applied to the Y electrodes. Further, the sustain driver 226 may be formed between the reset driver 225 and the scan driver 223.

A process for applying the sustain voltage $V_s$ to the Y electrodes in the sustain period according to an exemplary embodiment of the present invention will now be described.

In an earlier stage of the sustain period, the switch $Y_r$ and the switch $Y_{np}$ may be turned on to charge the voltage of $V_s$ in the Y electrodes by resonance between the inductor L and the panel capacitor $C_P$.

The voltage at the Y electrode may be maintained at the voltage of $V_s$ when the switch $Y_r$ and the switch $Y_{np}$ are turned off, and the switch $Y_s$ of the sustain driver 226 is turned on. The sustain discharge voltage of $V_s$ may be applied to the Y electrodes through a path shown in FIG. 5 by an arrow.

As shown in FIG. 5, waveform distortion caused by parasitic inductance on a main discharging path may be reduced because the path through which the sustain discharging voltage $V_s$ is applied to the Y electrodes does not include the main discharging path in the reset driver 325.

Figure 6:
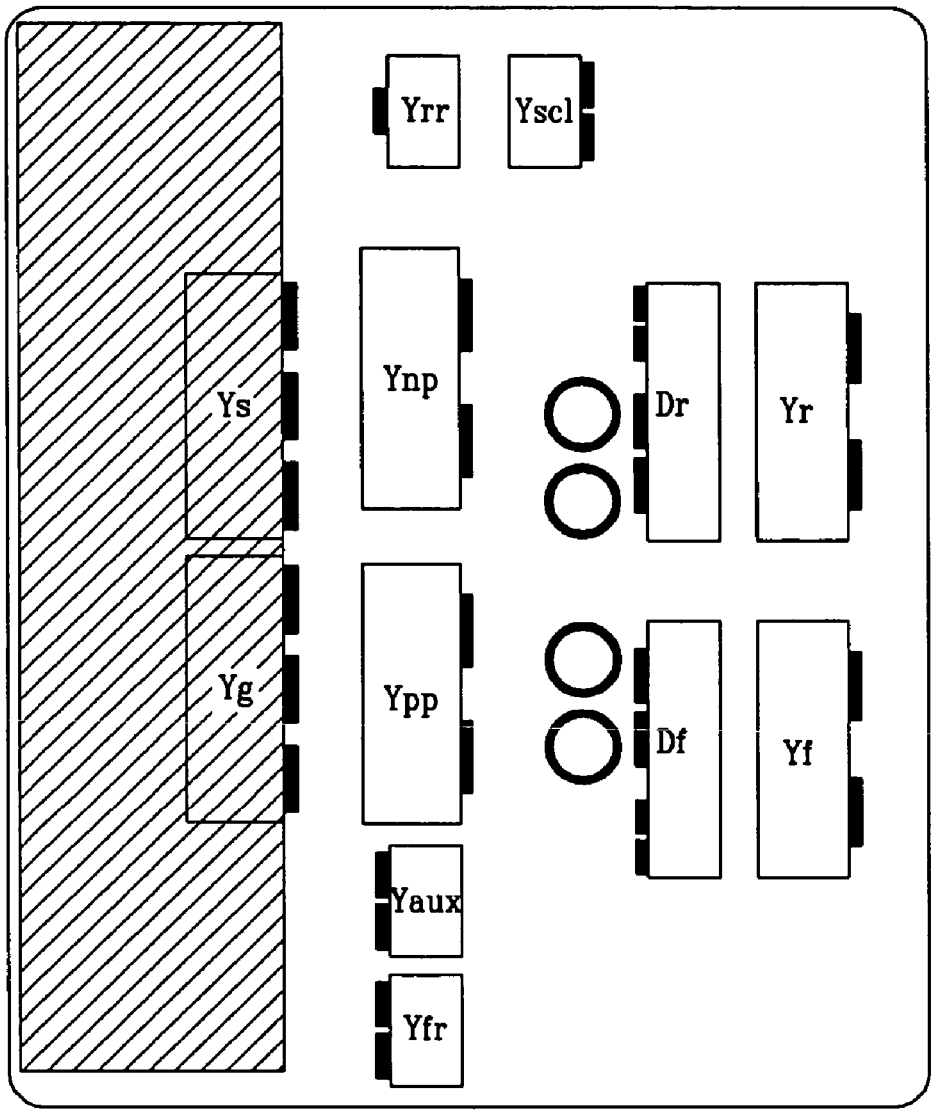
FIG. 6 is a diagram showing a circuit arrangement of a scan electrode driving circuit according to an exemplary embodiment of the present invention.

FIG. 6 is a diagram showing a circuit arrangement of a Y electrode driver according to an exemplary embodiment of the present invention.

As shown in FIG. 6, the switches Ys and Yg of the sustain driver 226 may be provided on a pattern (illustrated with oblique lines) that is coupled to the Y electrodes. Accordingly, a pattern may be easier to design and pattern impedance may be minimized.

According to exemplary embodiments of the present invention described above, the path through which the sustain discharging voltage is applied to the Y electrodes is reduced, the parasitic inductance on the main discharging path is reduced, and waveform distortion due to the parasitic inductance is prevented, which may improve discharging quality. The present invention may be particularly effective with large-sized panels of greater than fifty inches.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel driving apparatus that applies a voltage to a first electrode of a panel capacitor, comprising:

a first terminal of an inductor coupled to the first electrode;

a first switch coupled between a second terminal of the inductor and a first power that supplies a first voltage;

a second switch coupled between the second terminal of the inductor and the first power;

a reset driver coupled between the first terminal of the inductor and the first electrode, for applying a reset voltage to the first electrode in a reset period;

a third switch coupled between a node of the reset driver and the first electrode, and a second power that supplies a second voltage for sustain discharging; and a fourth switch coupled between the node of the reset driver and the first electrode, and a third power that supplies a third voltage.

2. The apparatus of claim 1, wherein the first switch is turned on to charge the panel capacitor by resonance of the panel capacitor and the inductor;

wherein the second switch is turned on to discharge the panel capacitor by resonance of the panel capacitor and the inductor; and wherein the third switch is turned on to maintain a voltage at the panel capacitor at the second voltage.

3. The apparatus of claim 1, further comprising:

a fifth switch coupled to a fourth power applying a fourth voltage and the first terminal of the inductor, wherein the fifth switch supplies the fourth voltage to the first electrode in the reset period.

4. The apparatus of claim 1, further comprising:

a first diode coupled between the second terminal of the inductor and the first power, and determining a direction of current so that the panel capacitor may be charged; and a second diode coupled between the second terminal of the inductor and the first power, and determining a direction of current so that the panel capacitor may be discharged.

5. The apparatus of claim 1, further comprising:

a selecting circuit coupled between a node of the fourth switch and the fifth switch, and the first electrode, wherein the selecting circuit applies a scan voltage to the first electrode in an address period.

6. The apparatus of claim 2, wherein the first voltage equals the second voltage.

7. The apparatus of claim 1, wherein the first voltage equals the third voltage.

8. The apparatus of claim 1, wherein the third switch is a transistor having a body diode, and the apparatus further comprises a third diode coupled between the second power and the first electrode and interrupting a current path of the body diode.

9. The apparatus of claim 1, wherein the fourth switch is a transistor having a body diode, and the apparatus further comprises a fourth diode coupled between the third power and the first electrode and interrupting a current path of the body diode.

10. A method for driving a plasma display panel apparatus comprising a first terminal of an inductor coupled to a first electrode of a panel capacitor; a first switch coupled between a second terminal of the inductor and a first power that supplies a first voltage; a second switch coupled between the second terminal of the inductor and the first power; a reset driver coupled between the first terminal of the inductor and the first electrode, for applying a reset voltage to the first electrode in a reset period; a third switch coupled between a node of the reset driver and the first electrode, and a second power that supplies a second voltage for sustain discharging; and a fourth switch coupled between the node of the reset driver and the first electrode, and a third power that supplies a third voltage, the method comprising:

turning on the first switch and charging the panel capacitor by resonance of the inductor and the panel capacitor;

turning off the first switch and turning on the third switch to maintain a voltage at the first electrode at the second voltage;

turning on the second switch and discharging the panel capacitor by resonance of the inductor and the panel capacitor; and turning off the second switch and turning on the fourth switch to maintain the voltage at the first electrode at the third voltage.

11. The method of claim 10, further comprising applying a current to the inductor through a path generated by turning on the first switch and the fourth switch prior to turning on the first switch; and applying a current to the inductor through a path generated by turning on the second switch and the third switch prior to turning on the second switch.

12. A plasma display panel (PDP) device, comprising:

a panel unit including a plurality of first electrodes and a plurality of second electrodes formed on a substrate;

a chassis base having a driving board for driving the panel unit;

wherein the driving board has a circuit for applying a voltage for sustain discharging to the first electrodes;

wherein the driving board comprises an inductor of which a first terminal is coupled to the first electrode; a first switch coupled between a second terminal of the inductor and a first power supplying a first voltage; a second switch coupled between the second terminal of the inductor and the first power; a reset driver coupled between the first terminal of the inductor and the first electrode, for applying a reset voltage to the first electrode in a reset period; a third switch coupled between a node of the reset driver and the first electrode, and a second power supplying a second voltage for sustain discharging; and a fourth switch coupled between the node of the reset driver and the first electrode, and a third power supplying a third voltage.

13. The PDP device of claim 12, further comprising:

a scan buffer board mounted on the chassis base and coupled to the plurality of first electrodes, wherein the scan buffer board has a selecting circuit which applies a scan voltage to the first electrodes in an address period.

14. The PDP device of claim 13, wherein the first switch and the second switch are adjacent to the scan buffer board.

* * * * *